US009167911B2

(12) United States Patent
Vlosich

(10) Patent No.: US 9,167,911 B2
(45) Date of Patent: Oct. 27, 2015

(54) FIRST ELECTRONIC TABLET HIGH CHAIR

(71) Applicant: Stephanie Vlosich, Poland, OH (US)

(72) Inventor: Stephanie Vlosich, Poland, OH (US)

( * ) Notice: Subject to any disclaimer, the term of this patent is extended or adjusted under 35 U.S.C. 154(b) by 0 days.

(21) Appl. No.: 14/499,675

(22) Filed: Sep. 29, 2014

(65) Prior Publication Data

US 2015/0090162 A1 Apr. 2, 2015

Related U.S. Application Data

(60) Provisional application No. 61/885,205, filed on Oct. 1, 2013.

(51) Int. Cl.

| | |
|---|---|
| ***A47B 23/00*** | (2006.01) |
| ***A47D 11/00*** | (2006.01) |
| ***A47D 3/00*** | (2006.01) |
| ***A47D 1/00*** | (2006.01) |
| ***A45C 11/00*** | (2006.01) |

(52) U.S. Cl.

CPC ..... *A47D 11/00* (2013.01); *A45C 11/00* (2013.01); *A47B 23/00* (2013.01); *A47D 1/008* (2013.01); *A47D 3/00* (2013.01)

(58) Field of Classification Search

CPC .... B60R 11/02; B60R 11/00; B60R 11/0223; B60R 11/0252; B60N 2/4876; B60N 2/4879; A47C 7/62; A47C 7/68; A47C 7/725; A47B 21/00; A47B 21/04; A47B 2021/0076

USPC ..... 108/43, 50.01, 50.02, 27, 50.11; 297/217.3, 217.6, 153

See application file for complete search history.

(56) References Cited

U.S. PATENT DOCUMENTS

| | | | | |
|---|---|---|---|---|
| 1,430,207 | A * | 9/1922 | Woodhouse | 108/43 |
| 3,187,687 | A * | 6/1965 | Malmer | 108/43 |
| 5,254,007 | A * | 10/1993 | Eagan | 108/43 |
| 6,003,446 | A * | 12/1999 | Leibowitz | 108/43 |
| 6,286,440 | B1 * | 9/2001 | Jyringi | 108/50.01 |
| 6,354,044 | B1 * | 3/2002 | Lagace, Jr. | 297/184.14 |
| 6,367,392 | B2 * | 4/2002 | Moore | 108/27 |
| 6,932,377 | B2 * | 8/2005 | Bretschger et al. | 280/642 |
| 7,065,319 | B1 * | 6/2006 | Hartley | 434/307 R |
| 7,150,236 | B1 * | 12/2006 | Riley | 108/43 |
| 7,328,941 | B2 * | 2/2008 | Asbach et al. | 297/153 |
| 7,861,991 | B1 | 1/2011 | Sylvertooth-Jackson | |
| 8,322,290 | B1 * | 12/2012 | Mignano | 108/43 |
| 8,322,292 | B2 * | 12/2012 | Chen | 108/43 |
| 8,327,774 | B1 * | 12/2012 | Rivera | 108/44 |
| 8,424,464 | B2 * | 4/2013 | Korpi | 108/27 |
| 8,635,959 | B1 * | 1/2014 | Silknitter | 108/43 |
| 8,654,517 | B2 * | 2/2014 | Aumiller et al. | 108/50.01 |
| 8,677,911 | B2 * | 3/2014 | McRorie | 108/50.02 |
| 8,758,135 | B2 * | 6/2014 | Carter et al. | 297/219.12 |
| D724,043 | S * | 3/2015 | Umezawa | D14/130 |

(Continued)

*Primary Examiner* — Jose V Chen

(74) *Attorney, Agent, or Firm* — Harpman & Harpman

(57) ABSTRACT

A utility multi-function tray attachment for children's high chairs that provides an integrated insert retainment and display area for electronic entertainment computer based devices of tablet configurations. The tray has a perimeter lip formed thereon with a tray top surface having a transparent waterproof viewing and activation surface window for display and activation of a computer tablet selectively inserted into and retained in the tray. Chair adapted receiving brackets on said tray bottom provide for universal engagement and a pair of folding deployable legs provide for dependent and independent tray use with a variety of high chair designs.

7 Claims, 4 Drawing Sheets

(56) References Cited

U.S. PATENT DOCUMENTS

| | | | | |
|---|---|---|---|---|
| 2006/0113342 | A1 | 6/2006 | Hampton et al. | |
| 2009/0033118 | A1 | 2/2009 | Gomez | |
| 2010/0064945 | A1* | 3/2010 | Sierenberg | 108/50.02 |
| 2011/0240448 | A1 | 10/2011 | Springer et al. | |
| 2012/0160136 | A1* | 6/2012 | Lineal et al. | 108/43 |
| 2013/0010053 | A1* | 1/2013 | Daddi | 297/217.3 |

* cited by examiner

FIRST ELECTRONIC TABLET HIGH CHAIR

This application claims the benefit of U.S. Provisional Application No. 61/885,205, filed Oct. 1, 2013.

BACKGROUND OF THE INVENTION

1. Technical Field

This invention relates to children's high chairs and trays that provide a safe and secure environment for babies and small children. Such removable trays are used for both mealtime and play time.

2. Description of Prior Art

Prior art devices of this type have relied on a variety of tray designs that provide a child accessible surface while also limiting the child's movement beyond the chair, see for example U.S. Pat. No. 7,861,991 and U.S. Publications 2006/0113342, 2009/0033118 and 2011/0240448.

In U.S. Pat. No. 7,861,991 an attachment for a portable multimedia device is disclosed having an adjustable support arm with a tray assembly on which a device is secured by straps on its surface.

U.S. Publication 2006/0113342 discloses a portable DVD holder that can be selectively secured by a pair of extending containment bands to a tray of a child's stroller.

U.S. Publication 2009/0033118 claims an accessory tray for a stroller including a compartment for a portable entertainment device accessible through an opening in the bottom thereof. A clear cover may be used to enclose the compartment.

Finally, in U.S. Publication 2011/0240448 illustrates a tablet computing device having a protective case in which a tablet computer can be held.

SUMMARY OF THE INVENTION

An integrated tray housing for an electronic tablet for high chairs. The tray housing has a recessed compartment within the tray surface to receive, retain and display an electronic tablet. An access opening on the tray allows insertion and removal while a transparent waterproof sensory input cover overlies the tablet touch sensitive screen surface affording controlled input thereto. Universal chair attachment fittings are provided for high chair mounting and a pair of deployable support legs for independent use without the chair.

DETAILED DESCRIPTION OF THE INVENTION

Figure 1:
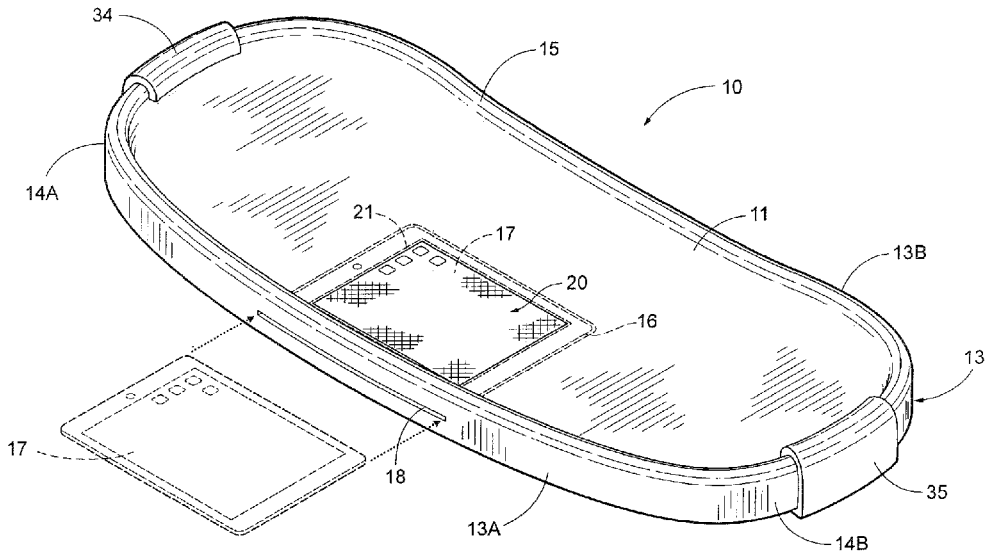
FIG. 1 is a perspective exploded view of the high chair tray of the invention with an electronic tablet positioned for insertion.
Figure 2:
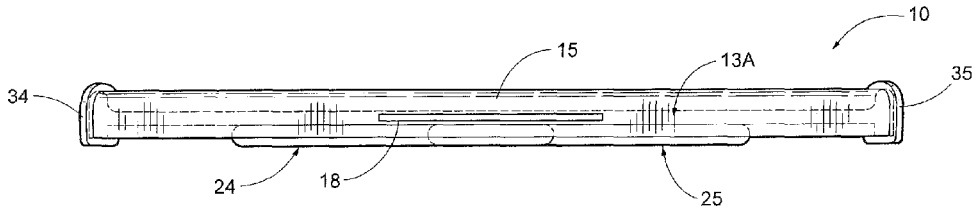
FIG. 2 is a front elevational view of the high chair tray.
Figure 4:
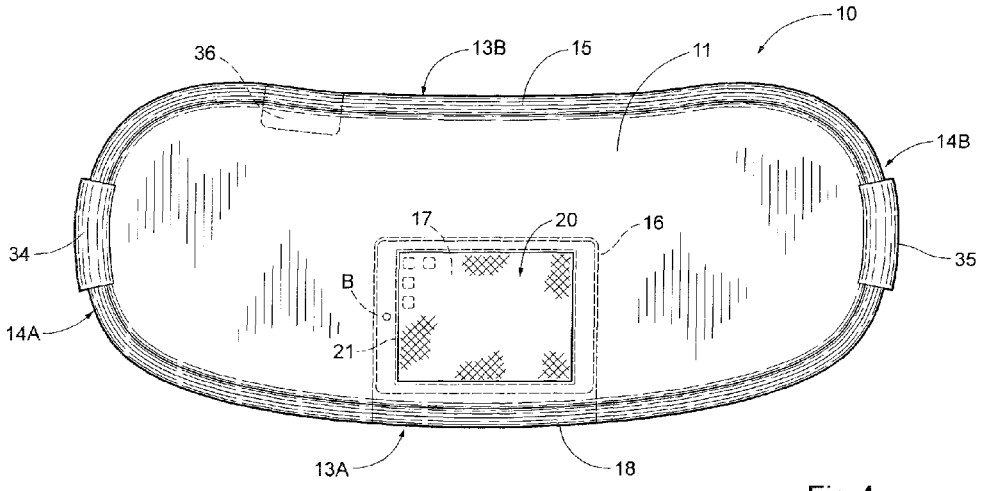
FIG. 4 is a top plan view of the electronic tablet receiving tray.

Referring to FIGS. 1 and 4 of the drawings, an electronic tablet receiving tray 10 of the invention for use with a high chair, not shown, can be seen having a main body member with a top surface 11 and bottom surface 12, said top surface has a contoured perimeter upstanding lip with an exterior depending continuous contoured sidewall 13 defining a front edge portion 13A, a rear edge portion 13B and oppositely disposed respective side edge portions 14A and 14B.

In this example chosen for illustration, a perimeter contoured upstanding lip 15 is formed about the top surface edge as will be well understood by those skilled in the art.

A compartment 16 is formed within the top surface 11 into which an electronic tablet 17 is selectively inserted through an access opening 18 in the front edge portion 13A indicated by directional arrows in FIG. 1 of the drawings. The compartment 16 provides registerable retainment of the electronic tablet 17 therewithin as illustrated best in FIG. 4 of the drawings. A viewing and control input opening at 19 in the top surface 11 overlies the compartment 16 and has a transparent touch sensitive thin waterproof flexible cover 20 sealed about its respective perimeter edge within an edge recess 21 in the top surface 11 as illustrated by broken lines.

The cover 20 is flush with the surrounding top surface 11 affording a smooth continuous tray surface S. The edge recess 21 extends to cover oppositely disposed portions 17A and 17B of the electronic tablet 17 restricting user (child's access) to the main control button B illustrated in this example as would be positionably found in an Apple® brand electronic tablet. This orientation would allow the caregiver to select the tablet's entertainment application prior to insertion thus preventing the child from random access to the remaining apps on the device once inserted and positioned as described above.

The compartment 16 extends generally from the front edge portion 13A inwardly so as to position the tablet 17 within the user's field of both viewable and tactile access.

Figure 7:
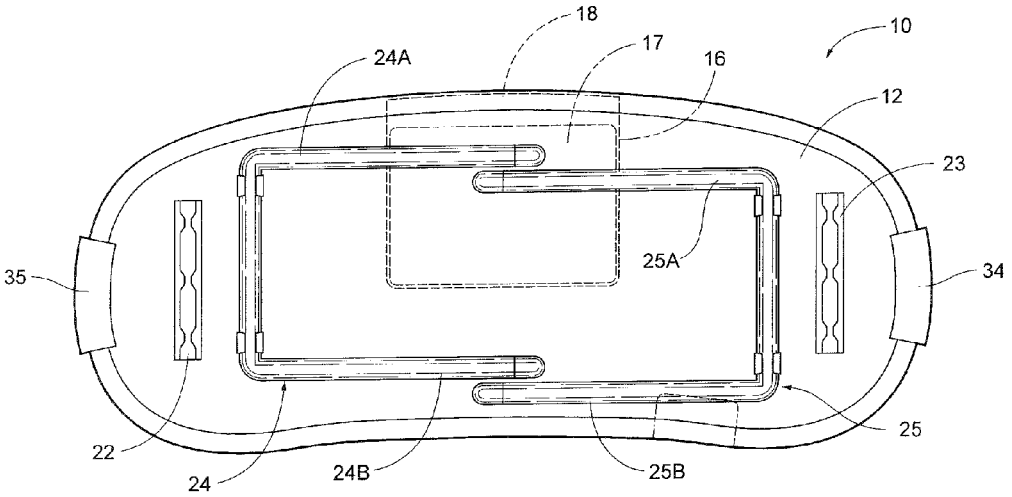
FIG. 7 is a bottom plan view of the electronic tablet receiving tray illustrating support legs in stored position and chair attachment fittings.

Referring now to FIG. 7 of the drawings, the bottom surface 12 of the main tray body member can be seen having a pair of universal spaced parallel high chair rail/arm engagement fittings 22 and 23 which are configured to be engaged and retained on a high chair engagement and retainment surface arms and selectively locked into place as will be understood by those within the art.

Such high chair tray engagement and retainment and release mechanisms are well known and would be in compliance with the current safety and release activation requirements and placements within the industry that further description and elaboration is not required.

A pair of hinged leg assemblies 24 and 25 can be seen that are secured to and are deployable from corresponding hinge leg engagement fittings extending from tray member's 10 bottom surface 12 adjacent the hereinbefore described chair engagement fittings 22 and 23.

Figure 5:
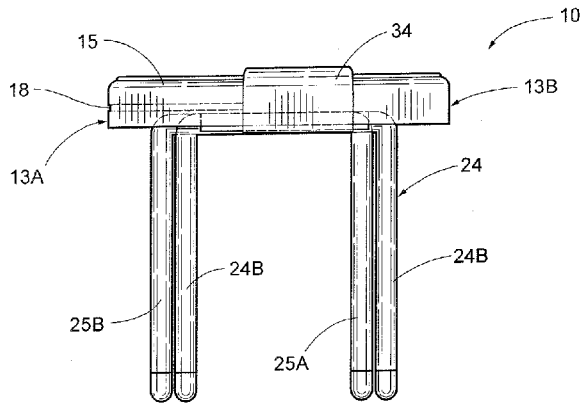
FIG. 5 is an end view with deployable legs illustrated.

The leg assemblies 24 and 25 extend along the bottom surface 13 overlying the hereinbefore described compartment 16 indicated in broken lines. In this example chosen for illustration, each of the leg assemblies 24 and 25 has a U-shaped hinge leg 24A, 24B, 25A and 25B defining a pair of end leg portions. Each of the hinge leg assemblies 24 and 25 can therefore be extended from the tray bottom as seen in FIGS. 5 and 6 of the drawings to a fully deployed extended position allowing for independent support of the tray on a ground surface GS.

Figure 3:
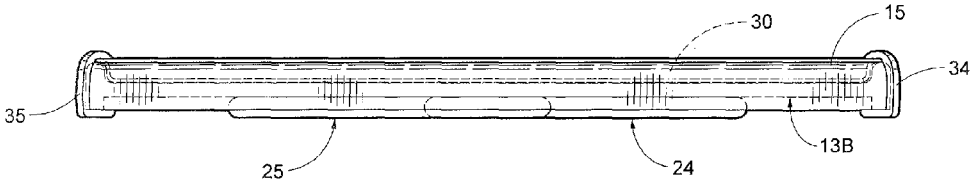
FIG. 3 is a rear elevational view thereof.
Figure 6:
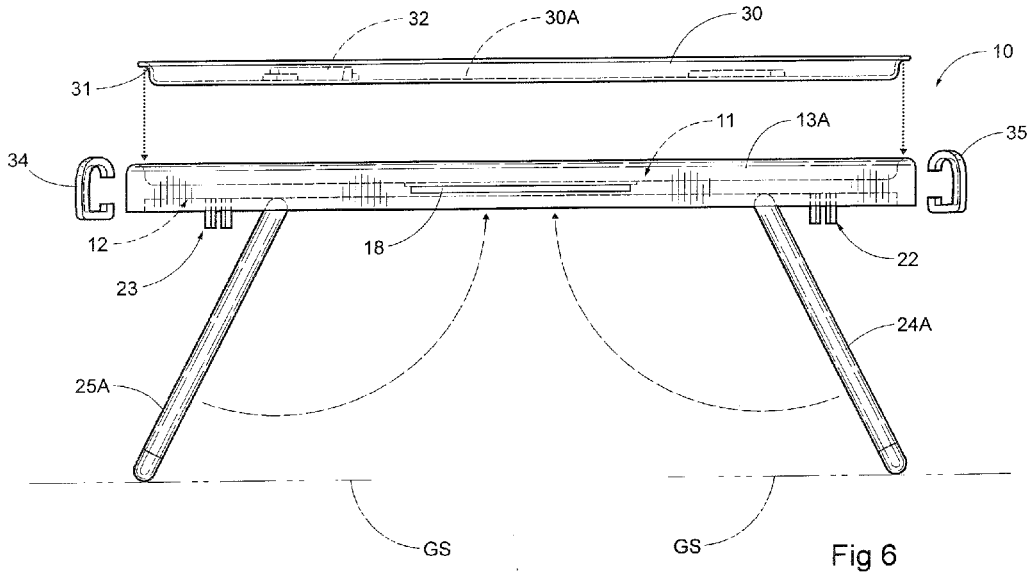
FIG. 6 is an exploded front elevational view with deployable legs extended and insert tray positioned for placement.
Figure 8:
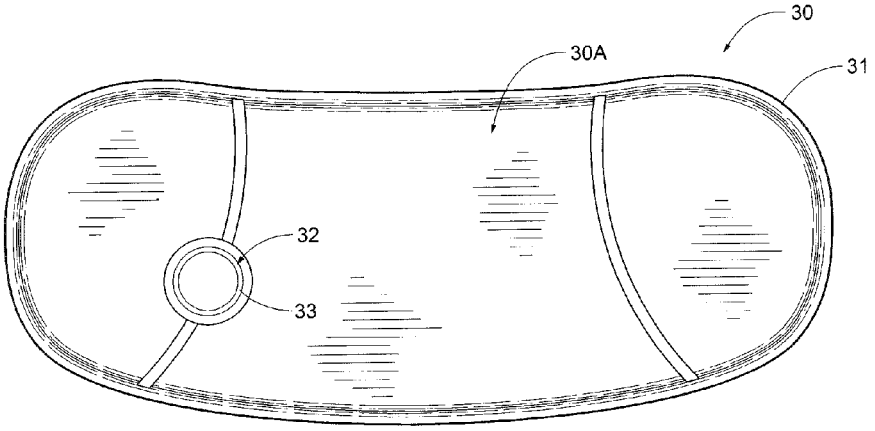
FIG. 8 is a top plan view of an insert activity cover for the tray.

Referring now to FIGS. 3, 6 and 8 of the drawings, a tray top insert 30 can be seen of a corresponding nesting dimension to that of the upper surface of the tray member 10. The tray top insert 30 is of a monolithic molded synthetic resin form having a perimeter upstanding edge contour 31, best seen in FIG. 6 of the drawings, allowing it to be registerably received and retained within the top surface 12 as illustrated in FIG. 3 of the drawings in broken lines.

The tray top insert 30 has, as noted, is a continuous surface 30A with, in this example, a cup receiving area 32 defined by an annular upstanding rib configuration 33.

A pair of tray handles 34 and 35 are provided on the respective side edge portions 14A and 14B. Each of the tray handles is of a cross-sectional C-shape and are of a yielding resilient nature so as to be engageable over the respective side edge profiles. The handles 34 and 35 additionally act as a secondary retainment for the hereinbefore described tray top insert 30. The handles 34 and 35 also provide for assistance in placing and removing the tray 10 from the high chair, not shown, as hereinbefore described so known to those skilled in the art.

A self-powered speaker amplifier assembly 36 may be positioned within a mounting area 37 formed on the bottom surface 13 of the tray 10 adjoining the rear depending edge 13B. Speaker amplifier assembly 36 is powered by an onboard battery that may be rechargeable and is interlinked to an inserted electronic tablet 17 in the compartment 16 by a communication wire and auxiliary plug adapted to be registerably in communication therewith.

The speaker amplifier assembly 36 will therefore provide amplified sound output from the tablet 17 for the user while maintaining the electronic tablet 17 within its protective user assessable visible display configuration defined by the touch sensitive screen over the compartment 16, as noted.

In operation, once the child, not shown, is placed into the high chair, not shown, and secured, the tray 10 of the invention is placed over the child's lap and onto the high chair by the locking engagement of the universal chair rail and arm engagement fittings 22 and 23. A remote release and lock indicated generally by M in this example located under the front depending edge 13A provides the required safety access by the caregiver for tray positioning currently a standard in the industry.

Once so positioned, the electronic tablet tray 10 aids in preventing the child from falling out of the chair and provides a usable utility play surface for the addition of direct access to the electronic tablet 17 which has been inserted and positioned within the tray for use as previously described.

It will be evident from the above description that the electronic tablet 17 so provided and inserted is not only viewable through the touch screen surface by the child, but also is protected in a secure liquid resistant configuration enclosure therewithin. The view screen, as noted, is of a touch conductive activation material that allows the users to activate the tablet's touch screen therethrough having an electrical resistant inducing material composition which is currently commonly available within the industry as, for example, is used in waterproof touch screen smart phone covers.

It will thus be noted that the child and caregiver may access the touch screen of the electronic tablet 17 while the critical controls on the tablet such as the enter button B are not accessible while within the electronic tablet tray 10.

It will be evident that as with any touch screen electronic device, a stylus may also be used to afford greater flexibility and accurate use which may be required in certain applications as is commonly known.

The electronic tablet tray 10 can also, as previously noted, be removed from the high chair and used independently with the deployable leg assemblies 24 and 25 hereinbefore described. The leg assemblies 24 and 25 can be deployed as shown in FIG. 6 of the drawings and allowing the electronic tablet tray 10 to be placed on any compatible surface for independent use.

It will thus be seen that a new and novel electronic tablet tray has been illustrated and described and it will be apparent to those skilled in the art that various changes and modifications may be made thereto without departing from the spirit of the invention.

The invention claimed is:

1. A tray for attachment to a high chair, said tray comprising, a main body member having a top displayed surface, and oppositely disposed bottom surface and a contoured depending perimeter edge, a compartment in said main body member, a opening in said top display surface in alignment with said compartment, a transparent touch sensitive flexible screen cover overlying said opening in said top display surface, said compartment of a dimension to receive and retain an electronic device therein, a pair of high chair engagement fittings configured on said oppositely disposed bottom surface.

2. The tray set forth in claim 1 wherein said contoured depending perimeter edge further comprises, a continuous front edge portion, rear edge portion, and oppositely disposed side edge portions.

3. The tray set forth in claim 2 wherein said oppositely disposed side edge portions have resilient handles movably positioned thereon.

4. The tray set forth in claim 1 wherein said tray top display surface has a continuous upstanding perimeter contoured lip integral therewith.

5. The tray set forth in claim 1 further comprises leg assemblies hinged from said bottom surface, movable from a first position on said bottom surface to a second extended deployed ground engagement position.

6. The tray set forth in claim 1 wherein said high chair engagement fittings further comprise, a remote lock and release latch mechanism.

7. The tray set forth in claim 1 further comprises a continuous surface top tray insert nesting configuration into said tray top display and upstanding lip overlying said display opening.

* * * * *